US011030941B2

(12) United States Patent
Park et al.

(10) Patent No.: US 11,030,941 B2
(45) Date of Patent: Jun. 8, 2021

(54) DISPLAY DRIVING DEVICE AND DISPLAY DEVICE INCLUDING THE SAME

(71) Applicant: Magnachip Semiconductor, Ltd., Cheongju-si (KR)

(72) Inventors: Yeon Kyoung Park, Cheongju-si (KR); Hyoung Kyu Kim, Cheongju-si (KR); Dae Young Yoo, Cheongju-si (KR)

(73) Assignee: MagnaChip Semiconductor, Ltd, Cheongju-si (KR)

( * ) Notice: Subject to any disclaimer, the term of this patent is extended or adjusted under 35 U.S.C. 154(b) by 0 days.

(21) Appl. No.: 16/529,452

(22) Filed: Aug. 1, 2019

(65) Prior Publication Data

US 2020/0051493 A1 Feb. 13, 2020

(30) Foreign Application Priority Data

Aug. 10, 2018 (KR) ..... 10-2018-0093726

(51) Int. Cl.
*G09G 3/32* (2016.01)
*G09G 3/20* (2006.01)

(52) U.S. Cl.
CPC ..... *G09G 3/32* (2013.01); *G09G 3/2074* (2013.01); *G09G 2310/0259* (2013.01); *G09G 2310/0297* (2013.01); *G09G 2330/06* (2013.01)

(58) Field of Classification Search
CPC ..... G09G 3/32; G09G 3/2074
USPC ..... 345/32, 98, 99, 100, 204, 694; 714/727
See application file for complete search history.

(56) References Cited

U.S. PATENT DOCUMENTS 5,854,662 A * 12/1998 Yuyama ..... H04N 5/66 348/790
6,229,515 B1 * 5/2001 Itoh ..... G09G 3/3648 345/100
8,139,016 B2 3/2012 Yi
2001/0050661 A1 * 12/2001 Noda ..... H04N 9/3117 345/32
2002/0008688 A1 * 1/2002 Yamamoto ..... G09G 3/3648 345/98
2004/0041826 A1 * 3/2004 Nakagawa ..... G09G 3/3614 345/694
2007/0245193 A1 * 10/2007 Wei ..... G09G 3/3677 714/727
2010/0164929 A1 * 7/2010 Chen ..... G09G 3/3688 345/211

(Continued)

*Primary Examiner* — Prabodh M Dharia
(74) *Attorney, Agent, or Firm* — NSIP Law

(57) ABSTRACT

A display driving device for driving a display panel includes a first driving circuit configured to output a first image signal, a second driving circuit configured to output a second image signal, a first switch circuit connected to the first driving circuit, and configured to transmit the first image signal to a part of a first set of sub-pixels arranged in the display panel based on a first switching signal during a first horizontal time interval, and a second switch circuit connected to the second driving circuit, and configured to transmit the second image signal to a part of a second set of sub-pixels arranged in the display panel adjacent to the first set of sub-pixels based on a second switching signal during the first horizontal time interval, wherein a width of the first switching signal and a width of the second switching signal in the first horizontal time differ from each other.

22 Claims, 12 Drawing Sheets

(56) References Cited

U.S. PATENT DOCUMENTS

| | | | | |
|---|---|---|---|---|
| 2013/0106807 | A1* | 5/2013 | Lin | H04N 13/398 345/204 |
| 2015/0084939 | A1* | 3/2015 | Chen | G09G 3/3607 345/204 |
| 2017/0039924 | A1* | 2/2017 | Jin | H01L 27/3213 |
| 2017/0169756 | A1* | 6/2017 | Kim | G09G 3/2092 |
| 2017/0249906 | A1* | 8/2017 | Noh | G09G 3/3266 |

* cited by examiner

DISPLAY DRIVING DEVICE AND DISPLAY DEVICE INCLUDING THE SAME

CROSS-REFERENCE TO RELATED APPLICATIONS

This application claims the benefit under 35 USC 119(a) of Korean Patent Application No. 10-2018-0093726 filed on Aug. 10, 2018 in the Korean Intellectual Property Office, the entire disclosure of which is incorporated herein by reference for all purposes.

BACKGROUND

1. Field

The following description relates to a display driving device. The following description also relates to a display device including such a display driving device. The following description also relates to a display driving device, and a display device including the such a display driving device, which may adjust the timings of signals used in the display driving device. Such adjustments may reduce noise.

2. Description of Related Art

In recent years, as a display driving device, or a driving circuit, processes more data, the amount of current used in the driving device is gradually increasing accordingly. In particular, the size enlargement and the high resolution of a display screen, and the improved picture quality of a panel in a flat panel display device act to increase the probability of occurrence of noise due to electromagnetic interference (EMI) in the panel.

The noise associated with the EMI may occur in the panel due to the temporary output of various signals for the display driving device, thus causing a malfunction of the display driving device.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a display driving device for driving a display panel includes a first driving circuit configured to output a first image signal, a second driving circuit configured to output a second image signal, a first switch circuit connected to the first driving circuit, and configured to transmit the first image signal to a part of a first set of sub-pixels arranged in the display panel based on a first switching signal during a first horizontal time interval, and a second switch circuit connected to the second driving circuit, and configured to transmit the second image signal to a part of a second set of sub-pixels arranged in the display panel adjacent to the first set of sub-pixels based on a second switching signal during the first horizontal time interval, wherein a width of the first switching signal and a width of the second switching signal in the first horizontal time differ from each other.

A falling time point of the first switching signal may be earlier than a falling time point of the second switching signal during the first horizontal time interval.

A rising time point of the first switching signal may be the same as a rising time point of the second switching signal during the first horizontal time interval.

The first switch circuit may be further configured to transmit the first image signal to another part of the first set of sub-pixels based on a third switching signal during a second horizontal time interval following the first horizontal time interval, the second switch circuit may be further configured to transmit the second image signal to another part of the second set of sub-pixels based on a fourth switching signal during the second horizontal time interval, and a width of the third switching signal and a width of the fourth switching signal may differ from each other during the second horizontal time interval.

The first driving circuit may include a first multiplexer configured to output one pixel data of first pixel data and second pixel data in response to a first selection signal received during the first horizontal time interval, the second driving circuit may include a second multiplexer configured to output one pixel data of third pixel data and fourth pixel data in response to a second selection signal received during the first horizontal time interval, a phase of the first selection signal and a phase of the second selection signal may differ from each other during the first horizontal time interval, and a width of the first selection signal and a width of the second selection signal may be the same.

A falling time point of the first selection signal may be earlier than a falling time point of the second selection signal during the first horizontal time interval.

The first driving circuit may further include a first latch configured to output the first pixel data and the second pixel data into the first multiplexer, and a first source amplifier configured to output a first voltage corresponding to the one pixel data output from the first multiplexer into the first set of sub-pixels as the first image signal, and the second driving circuit may further include a second latch configured to output the third pixel data and the fourth pixel data into the second multiplexer, and a second source amplifier configured to output a second voltage corresponding to the one pixel data output from the second multiplexer into the second set of sub-pixels as the second image signal.

The display driving device may further include a logic circuit configured to adjust the width of the first switching signal and the width of the second switching signal.

The logic circuit may be further configured to sequentially set the width of the first switching signal in each horizontal period as being a reference width, as being a value smaller than the reference width, as being the reference width, and as being a value greater than the reference width based on a four-cycle counter.

In another general aspect, a display device includes a display panel and a display driving device for driving the display panel, wherein the display panel includes sub-pixels arranged in the display panel, wherein the display driving device includes a first driving circuit configured to output a first image signal, a second driving circuit configured to output a second image signal, a first switch circuit connected to the first driving circuit, and configured to transmit the first image signal to a part of a first set of sub-pixels arranged in the display panel based on a first switching signal during a first horizontal time interval, and a second switch circuit connected to the second driving circuit, and configured to transmit the second image signal to a part of a second set of sub-pixels arranged in the display panel adjacent to the first set of sub-pixels based on a second switching signal during the first horizontal time interval, and wherein a width of the first switching signal and a width of the second switching signal in the first horizontal time interval differ from each other.

A falling time point of the first switching signal may be earlier than a falling time point of the second switching signal in the first horizontal time interval.

The first driving circuit may include a first multiplexer configured to output one pixel data of first pixel data and second pixel data in response to a first selection signal received during the first horizontal time interval, and the second driving circuit may include a second multiplexer configured to output one pixel data of third pixel data and fourth pixel data in response to a second selection signal received during the first horizontal time interval, a phase of the first selection signal and a phase of the second selection signal may differ from each other during the first horizontal time interval, and a width of the first selection signal and a width of the second selection signal may be the same.

The display driving device may further include a logic circuit configured to adjust the width of the first switching signal and the width of the second switching signal, the logic circuit may be further configured to sequentially set the width of the first switching signal during each horizontal period as being a reference width, as being a value smaller than the reference width, as being the reference width, and as being a value greater than the reference width based on a four-cycle counter.

In another general aspect, a display driving device for driving a display panel in which a plurality of pixels are arranged in parallel includes a first driving circuit unit configured to output a first image signal into an odd-numbered pixel among the plurality of pixels, a second driving circuit unit configured to output a second image signal into an even-numbered pixel among the plurality of pixels, a first switch circuit unit interposed between the odd-numbered pixel and the first driving circuit unit, and configured to perform a switching operation for connecting the odd-numbered pixel and the first driving circuit unit, and a second switch circuit unit interposed between the even-numbered pixel and the second driving circuit unit, and configured to perform a switching operation for connecting the even-numbered pixel and the second driving circuit unit, wherein a switching timing of the first switch circuit unit and a switching timing of the second switch circuit unit may differ from each other.

The display driving device may further include a plurality of first switch circuits, and the switching timing of each of the plurality of first switch circuit units may be the same, and may further include a plurality of second switch circuits, and the switching timing of each of the plurality of second switch circuit units may be the same.

The first switch circuit unit may be further configured to perform the switching operation for connecting the odd-numbered pixel and the first driving circuit unit in response to a first switching signal, the second switch circuit unit may be further configured to perform the switching operation for connecting the even-numbered pixel and the second driving circuit unit in response to a second switching signal, wherein a width of the first switching signal and a width of the second switching signal may differ from each other.

The first driving circuit unit may be further configured to perform a data selection operation for selecting a part of the input pixel data, the second driving circuit unit may be further configured to perform a data selection operation for selecting a part of the input pixel data, and a data selection timing of the first driving circuit unit and a data selection timing of the second driving circuit unit may be different from each other.

In another general aspect, a display device includes a display panel and a display driving device for driving the display panel, wherein the display panel includes a plurality of pixels arranged in the display panel, wherein the display driving device includes a first driving circuit unit configured to output a first image signal into an odd-numbered pixel among the plurality of pixels, a second driving circuit unit configured to output a second image signal into an even-numbered pixel among the plurality of pixels, a first switch circuit unit interposed between the odd-numbered pixel and the first driving circuit unit, and configured to perform a switching operation for connecting the odd-numbered pixel and the first driving circuit unit, and a second switch circuit unit interposed between the even-numbered pixel and the second driving circuit unit, and configured to perform a switching operation for connecting the even-numbered pixel and the second driving circuit unit, wherein a switching timing of the first switch circuit unit and a switching timing of the second switch circuit unit differ from each other.

The display device may further include a plurality of first switch circuits, the switching timing of each of the plurality of first switch circuit units may be the same, and may further include a plurality of second switch circuits, and the switching timing of each of the plurality of second switch circuit units may be the same.

The first switch circuit unit may be further configured to perform the switching operation for connecting the odd-numbered pixel and the first driving circuit unit in response to a first switching signal, the second switch circuit unit may be further configured to perform the switching operation for connecting the even-numbered pixel and the second driving circuit unit in response to a second switching signal, and a width of the first switching signal and a width of the second switching signal may differ from each other.

The first driving circuit unit may be further configured to perform a data selection operation for selecting a part of the input pixel data, the second driving circuit unit may be further configured to perform a data selection operation for selecting a part of the input pixel data, and a data selection timing of the first driving circuit unit and a data selection timing of the second driving circuit unit may be different from each other.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
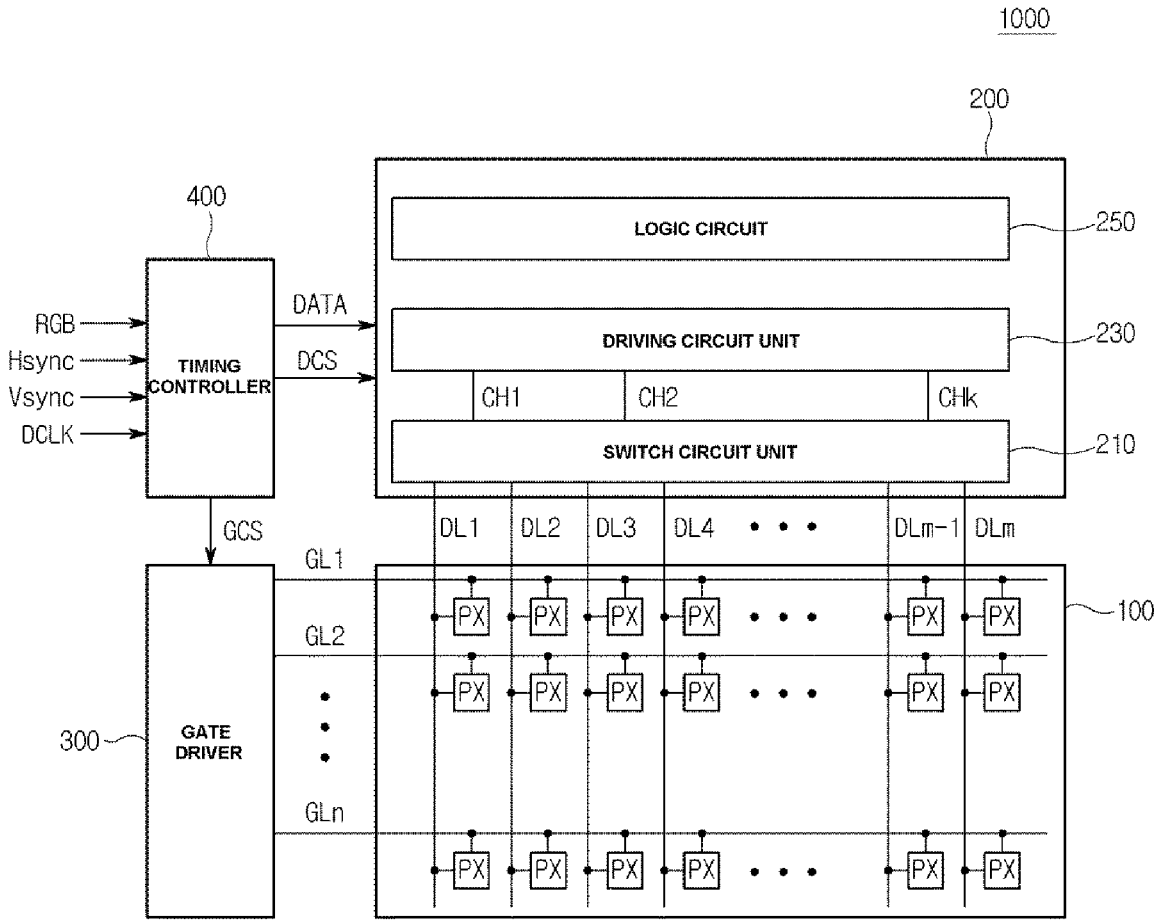
FIG. 1 is a diagram conceptually illustrating a display device according to an example.

Hereinafter, examples will be described with reference to the accompanying drawings.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

Herein, it is noted that use of the term "may" with respect to an example or embodiment, e.g., as to what an example or embodiment may include or implement, means that at least one example or embodiment exists where such a feature is included or implemented while all examples and embodiments are not limited thereto.

An object of the present disclosure is to provide a display driving device and a display device including the same, which may adjust the timings of signals used in the display driving device, thus reducing noise due to the EMI occurring in the display driving device.

The display driving device according to the examples may variously set the timings of the switching signals to variously set the switching timing of a switch circuit unit, thus reducing noise caused by EMI.

The display driving device according to the examples may variously set the timings of the selection signals to variously set the selection timings of the pixel data, thus reducing noise caused by EMI.

FIG. 1 is a diagram conceptually illustrating a display device according to an example. Referring to the example of FIG. 1, a display device 1000 includes a display panel 100, a display driving device 200, a gate driver 300, and a timing controller 400.

According to the examples, the display device 1000 may be a device capable of displaying an image or a video. For example, the display device 1000 may refer to a smartphone, a tablet personal computer, a mobile phone, a video phone, an e-book reader, a computer, a camera, or a wearable device, and so on, but the display device 1000 is not limited thereto.

The display panel 100 may include a plurality of subpixels PX, arranged in rows and columns. For example, the display panel 100 may be implemented by a technology chosen as being one of a Light Emitting Diode (LED) display, an Organic LED (OLED) display, an Active Matrix OLED (AMOLED) display, an ElectroChromic Display (ECD), a Digital Mirror Device (DMD), an Actuated Mirror Device (AMD), a Grating Light Value (GLV), a Plasma Display Panel (PDP), an Electro Luminescent Display (ELD), and a Vacuum Fluorescent Display (VFD), but the display technologies are not limited to these examples and other display panel technologies may be used in other examples.

The display panel 100 includes a plurality of gate lines GL1 to GLn, where n is a natural number, arranged in rows, a plurality of data lines DL1 to DLm, where m is a natural number, arranged in columns, and sub-pixels PX formed at intersections of the plurality of gate lines GL1 to GLn and the plurality of data lines DL1 to DLm. Accordingly, the display panel 100 includes a plurality of horizontal lines, and each of the horizontal lines is composed of the sub-pixels PX connected to one gate line. During one horizontal time interval, the sub-pixels arranged along one horizontal line may be driven, and during a next 1H horizontal time interval, the sub-pixels arranged along another horizontal line may be driven.

The sub-pixels PX may include a Light Emitting Diode (LED) and a diode driving circuit for independently driving the light emitting diode. The diode driving circuit may be connected to one gate line and one data line, and the light emitting diode may be connected between the diode driving circuit and a power supply voltage, for example, a ground voltage.

The diode driving circuit may include a switching element, for example, a Thin Film Transistor (TFT) connected to the gate lines GL1 to GLn. When a gate-on signal is applied from the gate lines GL1 to GLn to turn on the switching element, the diode driving circuit may supply an image signal, also referred to as a pixel signal, received from the data lines DL1 to DLm connected to the diode driving circuit to the light emitting diode. The light emitting diode may output an optical signal corresponding to the image signal.

Each of the sub-pixels PX may be one of a red element R for outputting red light, a green element G for outputting green light, and a blue element B for outputting blue light. Such pixels corresponding to red elements, green elements, and blue elements may be arranged in the display panel 100 according to various methods. According to the examples, the sub-pixels PX of the display panel 100 may be repeatedly arranged in the order of R, G, B, G, or B, G, R, G, and so on. However, these are only examples, and other ways of arranging the sub-pixels PX are also possible. For example, the sub-pixels PX of the display panel 100 may be arranged according to an RGB stripe structure or an RGB pentile structure, but is not limited thereto and other RGB structures are also possible.

The gate driver 300 may sequentially provide a gate on signal to the plurality of gate lines GL1 to GLn, in response to a gate control signal GCS. For example, the gate control signal GCS may include a gate start pulse for indicating the start of output of the gate on signal, a gate shift clock for controlling the output time point of the gate on signal, and so on.

When the gate start pulse is applied, the gate driver 300 may sequentially generate the gate on signal, for example, a gate voltage corresponding to a logic high, in response to the gate shift clock, and may sequentially supply the gate on signal to the plurality of gate lines GL1 to GLn. At this time, a gate off signal, for example, a gate voltage corresponding to a logic low, is supplied to the plurality of gate lines GL1 to GLn during a time period during which no gate on signal is supplied to the plurality of gate lines GL1 to GLn.

In response to a data control signal DCS, the display driving device 200 may convert digital image data DATA into analog image signals, and may provide the converted image signals to the plurality of data lines DL1 to DLm. The display driving device 200 may provide an image signal corresponding to one horizontal line to the plurality of data lines DL1 to DLm during a 1H time interval.

The display driving device 200 may be implemented as one semiconductor chip including a switch circuit unit 210, a driving circuit unit 230, and a logic circuit 250.

The switch circuit unit 210 may transmit the signals transmitted from the driving circuit unit 230 to the display panel 100. According to the examples, the switch circuit unit 210 may connect each of a plurality of channels CH1 to CHk to two data lines from among the plurality of data lines DL1 to DLm.

The switch circuit unit 210, according to the examples, may adjust the switching timings between the data lines of the plurality of channels CH1 to CHk, thereby reducing noise caused by EMI.

The driving circuit unit 230 may convert the image data DATA into image signals in response to receiving the data control signal DCS. The driving circuit unit 230 may thus output the image signals as a gray-scale voltage corresponding to the image data DATA, and may output such image signals to the plurality of channels CH1 to CHk, where k is a natural number having a value of m or less. For example, the data control signal DCS may include a source start signal, a source shift clock, a source output enable signal, and so on.

The logic circuit 250 may control an operation of the switch circuit unit 210 and the driving circuit unit 230. According to the examples, the logic circuit 250 may control the operation timings of the switch circuit unit 210 and the driving circuit unit 230. For example, as will be described further later, the logic circuit 250 may control the generation of various signals, for example, the signals of FIG. 3, used to operate the switch circuit unit 210 and the driving circuit unit 230.

According to examples, the logic circuit 250 may receive signals generated by the timing controller 400, and may accordingly control an operation of the switch circuit unit 210 and the driving circuit unit 230 based on the received signals.

The timing controller 400 may receive video image data RGB from an outside source, and may image-process the video image data RGB or convert it to be suitable for a structure of the display panel 100 to generate image data DATA. The timing controller 400 may transmit the image data DATA to the display driving device 200.

The timing controller 400 may receive a plurality of control signals from an external host device. For example, the control signals may include a horizontal synchronization signal Hsync, a vertical synchronization signal Vsync, and a clock signal DCLK.

The timing controller 400 may generate the gate control signal GCS and the data control signal DCS for controlling the gate driver 300 and the display driving device 200 based on the received control signals. The timing controller 400 may control various operational timings of the gate driver 300 and the display driving device 200, based on the gate control signal GCS and the data control signal DCS.

According to the examples, the timing controller 400 may control the gate driver 300 so that the gate driver 300 drives the plurality of gate lines GL1 to GLn based on the gate control signal GCS. The timing controller 400 may control the display driving device 200 so that the display driving device 200 provides the image signal to the plurality of data lines DL1 to DLm, based on the data control signal DCS.

The respective configurations of the display device 1000 may each be composed of a circuit capable of performing a corresponding function.

Figure 2:
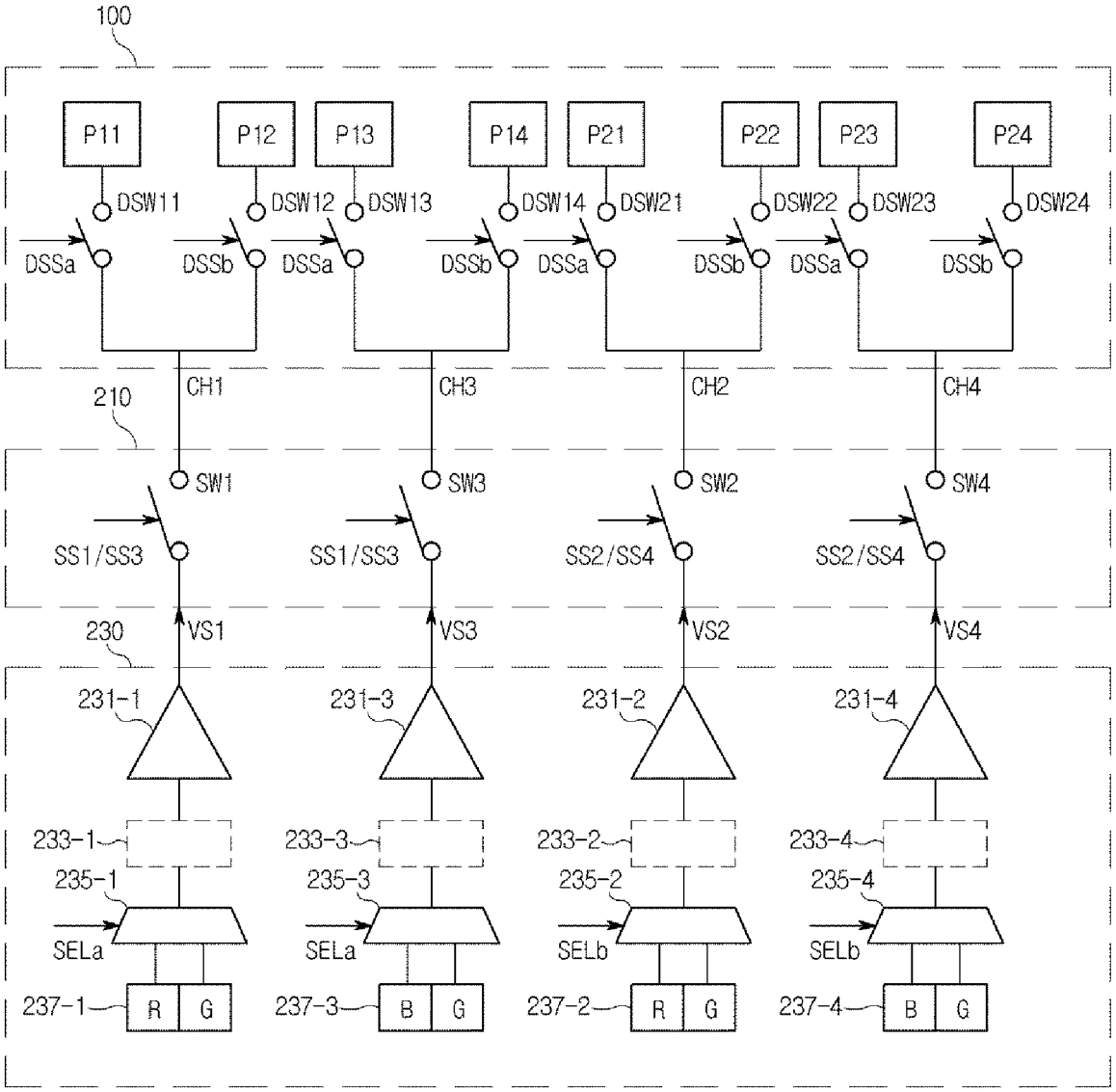
FIG. 2 is a diagram conceptually illustrating a display panel and a display driving device according to an example.

FIG. 2 is a diagram conceptually illustrating a display panel and a display driving device according to an example. Referring to the examples of FIGS. 1 and 2, the display panel 100 may include a plurality of sub-pixels P11 to P14 and P21 to P24 arranged in parallel and a plurality of data switches DSW11 to DSW14 and DSW21 to DSW24 connected to each of the plurality of sub-pixels P11 to P14 and P21 to P24. Each pair of the plurality of data switches DSW11 to DSW14 and DSW21 to DSW24 may be connected to the respective channels CH1 to CH4.

A first set of sub-pixels P11 to P14 and a second set of sub-pixels P21 to P24 may be arranged in parallel, and may also be arranged adjacent to each other. For example, the first set of sub-pixels P11 to P14 may be four consecutive sub-pixels, and the second set of sub-pixels P21 to P24 may be the next four consecutive sub-pixels.

The first set of sub-pixels P11 to P14 may be defined as constituting a first pixel, and the second set of sub-pixels P21 to P24 may be defined as constituting a second pixel. For example, the first pixel may be an odd-numbered pixel and the second pixel may be an even-numbered pixel.

The data switches DSW11 to DSW14 and DSW21 to DSW24 may be switched between the corresponding sub-pixel and channel based on data switching signals DSSa and DSSb. For example, the data switch DSW11 may connect the first channel CH1 and the sub-pixel P11 based on the first data switching signal DSSa, and the data switch DSW12 may connect the first channel CH1 and the sub-pixel P12 based on the second data switching signal DSSb. For example, when the first data switching signal DSSa is at a first level, for example, a logic low level, each of the data switches DSW11, DSW13, DSW21, and DSW23 may connect each of the channels CH1, CH3, CH2, and CH4 and each of the pixels P11, P13, P21, and P23 to one another. However, when the second data switching signal DSSb is at a logic low level, each of the data switches DSW12, DSW14, DSW22, and DSW24 may connect each of the channels CH1, CH3, CH2, and CH4 and each of the pixels P12, P14, P22, and P24 to one another.

According to the examples, the states, for example, turn-on or turn-off, of neighboring data switches, for example, DSW11 and DSW12, may differ from each other. That is, the data switch DSW12 may be turned off when the data switch DSW11 is turned on, and the data switch DSW11 may be turned off when the data switch DSW12 is turned on. Therefore, the analog image signal transmitted through each of the channels CH1 to CH4 may be selectively supplied to any one of two sub-pixels, for example, P11 and P12, connected to each of the channels CH1 to CH4 in response to receiving the data switching signal DSSa or DSSb.

The switch circuit unit 210 may include a first switch SW1, a second switch SW2, a third switch SW3, and a fourth switch SW4. According to the examples, the number of switches included in the switch circuit unit 210 may be the same as the number of channels.

A first switch circuit unit may include the first switch SW1 and the third switch SW3, and a second switch circuit unit may include the second switch SW2 and the fourth switch SW4. That is, the first switch circuit units SW1 and SW3 may be connected to the first set of sub-pixels P11 to P14, and the second switch circuit units SW2 and SW4 may be connected to the second set of sub-pixels P21 to P24.

In such an example, each of the switches SW1 to SW4 may perform a switching operation in order to connect each of source amplifiers 231-1 to 231-4 to each of the channels CH1 to CH4 in response to each of switching signals SS1 to SS4. According to the examples, the switches SW1 and SW3 may perform a switching based on the switching signals SS1 and SS3, and the switches SW2 and SW4 may perform a switching based on the switching signals SS2 and SS4.

According to the examples, the first switch SW1 may connect the first source amplifier 231-1 to the first channel CH1 based on the first switching signal SS1, and may connect the first source amplifier 231-1 to the third channel CH3 based on the third switching signal SS3. The third switch SW3 may connect the third source amplifier 231-3 to the third channel CH3 based on the first switching signal SS1, and may connect the third source amplifier 231-3 to the first channel CH1 based on the third switching signal SS3. Similarly, the second switch SW2 may connect the second source amplifier 231-2 to the second channel CH2 based on the second switching signal SS2, and may connect the second source amplifier 231-2 to the fourth channel CH4 based on the fourth switching signal SS4. The fourth switch SW4 may connect the fourth source amplifier 231-4 to the fourth channel CH4 based on the second switching signal SS2, and may connect the fourth source amplifier 231-4 to the second channel CH2 based on the fourth switching signal SS4.

For example, when the first switching signal SS1 is at a second level, for example, a logic high level, the first switch SW1 may connect the first source amplifier 231-1 and the first channel CH1, and the third switch SW3 may connect the third source amplifier 231-3 and the third channel CH3. When the third switching signal SS3 is at a logic high level, the first switch SW1 may connect the first source amplifier 231-1 and the third channel CH3, and the third switch SW3 may connect the third source amplifier 231-3 and the first channel CH1. Similarly, when the second switching signal SS2 is at a logic high level, the second switch SW2 may connect the second source amplifier 231-2 and the second channel CH2, and the fourth switch SW4 may connect the fourth source amplifier 231-4 and the fourth channel CH4. When the fourth switching signal SS4 is at a logic high level, the second switch SW2 may connect the second source amplifier 231-2 and the fourth channel CH4, and the fourth switch SW4 may connect the fourth source amplifier 231-4 and the second channel CH2. Accordingly, based on the switching signals, the source amplifiers and channels are connected to one another in a manner that changes appropriately.

The first switching signal SS1 and the third switching signal SS3 may be activated alternatively, and the second switching signal SS2 and the fourth switching signal SS4 may be activated alternatively. For example, a period during which the first switching signal SS1 is at a logic high level and a period during which the third switching signal SS3 is at a logic high level may not overlap with each other.

As is described further later, the display driving device 200 according to the examples may set the timings of the first switching signal SS1 and the second switching signal SS2 differently from each other, and may set the timings of the third switching signal SS3 and the fourth switching signal SS4 differently from each other. By variously setting the switching timings between the switches SW1 and SW3 and the switches SW2 and SW4, in this it manner, it may be possible to reduce noise based on EMI otherwise generated by a switching process.

The driving circuit unit 230 may include the source amplifiers 231-1 to 231-4, multiplexers 235-1 to 235-4, and latches 237-1 to 237-4, as illustrated in the example of FIG.

2. According to the examples, the driving circuit unit 230 may further include decoders 233-1 to 233-4 arranged between the source amplifiers 231-1 to 231-4 and the multiplexers 235-1 to 235-4, as illustrated in the example of FIG. 2.

For convenience, the first source amplifier 231-1, the first decoder 233-1, the first multiplexer 235-1, and the first latch 237-1 are collectively referred to as a first driving circuit. A second driving circuit, a third driving circuit, and a fourth driving circuit are also defined in a similar manner, with respect to their constituent parts. The first driving circuit unit may include the first driving circuit and the third driving circuit, and the second driving circuit unit may include the second driving circuit and the fourth driving circuit.

The first driving circuit unit may output image signals to the first pixel P11 to P14, and the second driving circuit unit may output image signals to the second pixel P21 to P24. Additionally, the first switch circuit unit SW1 and SW3 may perform a switching operation in order to connect the first pixel P11 to P14 and the first driving circuit unit, and the second switch circuit unit SW2 and SW4 may perform a switching operation in order to connect the second pixel P21 to P24 and the second driving circuit unit.

Additionally, the display driving device 200 according to the examples may include odd-numbered driving circuit units for outputting image signals to odd-numbered pixels among the pixels arranged in parallel in the display panel 100 and odd-numbered switch circuit units for performing a switching operation for connecting the odd-numbered pixels and the odd-numbered driving circuit units. The display driving device 200 according to the examples may also include even-numbered driving circuit units for outputting image signals to even-numbered pixels among the pixels arranged in parallel and even-numbered switch circuit units for performing a switching operation for connecting the even-numbered pixels and the even-numbered driving circuit units.

That is, as is consistent with the above description, the display driving device 200 according to the examples may set the switching timings of the odd-numbered switch circuit units and the switching timings of the even-numbered switch circuit units differently from each other, thus reducing noise resulting from EMI generated by a switching process.

Each of the source amplifiers 231-1 to 231-4 may output each of image signals VS1 to VS4 to the display panel 100 through the switch circuit unit 210.

Each of the latches 237-1 to 237-4 may store pixel data internally. According to the examples, each of the latches 237-1 to 237-4 may store at least one of red pixel data R, green pixel data G, and blue pixel data B internally. For example, the first latch 237-1 may store the red pixel data R and the green pixel data G internally.

The latches 237-1 to 237-4 may store the pixel data corresponding to each of the sub-pixels PX connected to the gate lines GL1 to GLn of the display panel 100 internally. For example, when the sub-pixels PX connected to the first gate line GL1 are driven, the latches 237-1 to 237-4 may store the pixel data corresponding to the light to be outputted by the sub-pixels PX connected to the first gate line GL1 internally, and when the sub-pixels PX connected to the second gate line GL2 are driven, the latches 237-1 to 237-4 may store the pixel data corresponding to the light to be outputted by the sub-pixels PX connected to the second gate line GL2 internally.

The multiplexers 235-1 to 235-4 may select one pixel data of the pixel data stored in the corresponding latches 237-1 to 237-4 based on selection signals SELa and SELb, and may output the selected one pixel data to the decoders 233-1 to 233-4 or the source amplifiers 231-1 to 231-4. For example, the first multiplexer 235-1 may select one pixel data, for example, R, of the pixel data R and G stored in the first latch 237-1 based on the first selection signal SELa, and may output the selected pixel data, for example, R, to the first decoder 233-1 or the first source amplifier 231-1.

As is described further later, the display driving device 200 according to the examples may set the timings of the first selection signal SELa and the second selection signal SELb differently from each other to variously set the selection timings of the pixel data at the multiplexers 235-1 to 235-4, thus reducing noise otherwise caused by EMI.

That is, as is consistent with the above description, the display driving device 200 according to the examples may set the data selection timings of the odd-numbered driving circuit units and the data selection timings of the even-numbered driving circuit units differently from each other, accordingly reducing noise based on EMI otherwise generated by a switching process.

The decoders 233-1 to 233-4 may output a gray-scale voltage corresponding to the pixel data selected and output the gray-scale voltage from the multiplexers 235-1 to 235-4 into the source amplifiers 231-1 to 231-4. According to the examples, the decoders 233-1 to 233-4 may receive a gray-scale voltage, for example, R gamma voltages, G gamma voltages, and B gamma voltages, corresponding to each of the pixel data, and may output a gray-scale voltage corresponding to the pixel data selected and output the gray-scale voltage from the multiplexers 235-1 to 235-4 into the source amplifiers 231-1 to 231-4.

The source amplifiers 231-1 to 231-4 may convert the pixel data output from the multiplexers 235-1 to 235-4 into the image signals VS1 to VS4, for example, using a digital to analog (DA) conversion, and may output the converted image signals VS1 to VS4 to the channels CH1 to CH4, or may alternatively output the gray-scale voltages, that is, gamma voltages corresponding to the pixel data, output from the decoders 233-1 to 233-4 into the channels CH1 to CH4 as the image signals VS1 to VS4.

According to the examples, the source amplifiers 231-1 to 231-4 may output the image signals VS1 to VS4 into the corresponding channels CH1 to CH4, through the connected switches SW1 to SW4. For example, the first source amplifier 231-1 may output the first image signal VS1 into the first channel CH1 or the third channel CH3 through the first switch SW1, the third source amplifier 231-3 may output the third image signal VS3 into the third channel CH3 or the first channel CH1 through the third switch SW3, the second source amplifier 231-2 may output the second image signal VS2 into the second channel CH2 or the fourth channel CH4 through the second switch SW2, and the fourth source amplifier 231-4 may output the fourth image signal VS4 into the fourth channel CH4 or the second channel CH2 through the fourth switch SW4.

Figure 3:
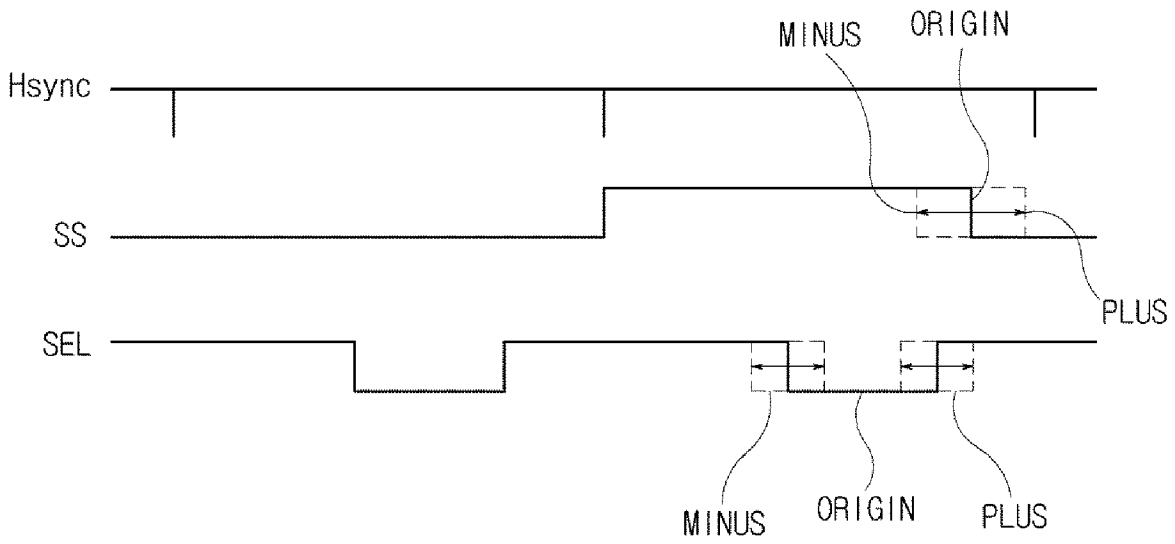
FIG. 3 is a diagram illustrating a switching signal and a selection signal used in the display driving device according to an example.

FIG. 3 is a diagram illustrating a switching signal and a selection signal used in the display driving device according to an example. Referring to the example of FIG. 3, the logic circuit 250 may generate the switching signals SS1 to SS4, collectively, referred to as SS, and the selection signals SELa and SELb, collectively, referred to as SEL.

According to the examples, in one horizontal time interval, the logic circuit 250 may adjust the width of the switching signals SS, and may adjust the phase of the selection signals SEL. For example, the logic circuit 250 may adjust the falling time point or rising time point of the switching signals SS, generate the switching signals SS having the adjusted falling time point or rising time point, adjust both the rising time point and the falling time point of the selection signals SEL, and generate the selection signals SEL having the adjusted rising time point and the adjusted falling time point.

For example, the logic circuit 250 may adjust the width of the switching signals SS to a reference width, for example, in an example of an ORIGIN as shown in FIG. 3, adjust it to be smaller than the reference width, for example, in an example of a MINUS as shown in FIG. 3, or adjust it to be greater than the reference width for example, in an example of a PLUS as shown in FIG. 3.

For example, the logic circuit 250 may adjust the phase of the selection signals SEL to a reference phase, such as in an example of ORIGIN, adjust it to be earlier than the reference phase, such as in an example of MINUS, or adjust it to be later than the reference phase, such as in an example of PLUS.

The logic circuit 250 may read the values stored in a register, and may generate the switching signals SS and the selection signals SEL based on the read values read from the register.

According to the examples, the logic circuit 250 may read at least one value from the register, and may adjust the falling time point or the rising time point of the switching signals SS using the at least one value read from the register to adjust the width of the switching signals SS.

According to the examples, the logic circuit 250 may read at least one value from the register, and may adjust the falling time point and the rising time point of the selection signals SEL using at least one value read from the register to adjust the phase of the selection signals SEL.

According to the examples, the logic circuit 250 may determine whether to adjust the width of the switching signals SS1 to SS4 based on the at least one value read from the register, may determine whether to adjust the phase of the selection signals SELa and SELb, may decide the width of the switching signals SS1 to SS4, and may decide the phase of the selection signals SELa and SELb.

Figure 4:
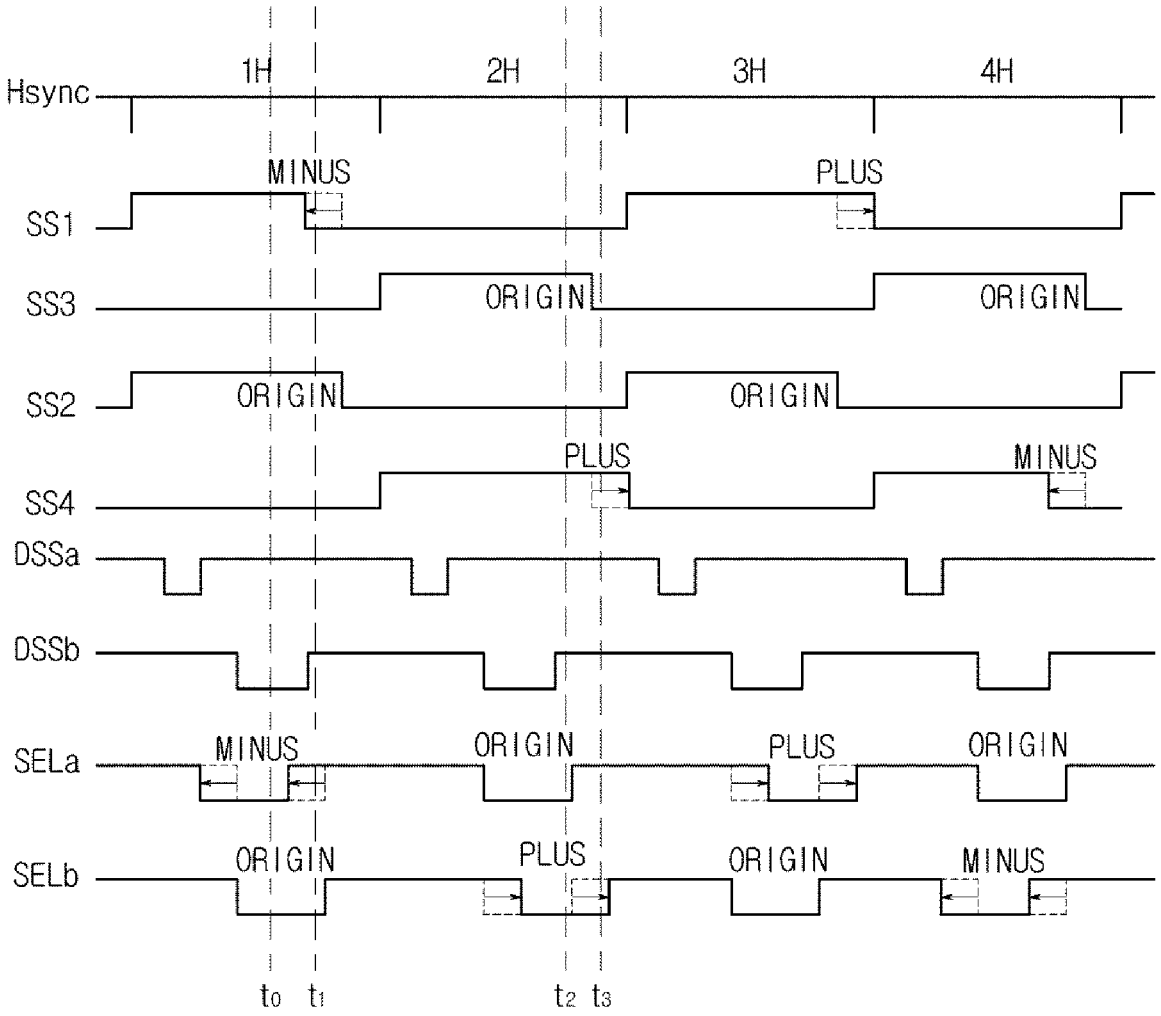
FIG. 4 is a timing diagram for explaining an operation of the display driving device according to an example.

FIG. 4 is a timing diagram for explaining an operation of the display driving device according to an example, and FIGS. 5 to 8 are diagrams illustrating the state of the display driving device at each time point in an example.

Lines 1H, 2H, 3H, and 4H may be synchronized by the horizontal synchronization signal Hsync. Referring to the examples of FIGS. 2 to 4, the logic circuit 250 may generate the switching signals SS1 and SS2, so that the width of the switching signals SS1 and SS2 is the reference width, in an example of ORIGIN, is smaller than the reference width, in an example of MINUS, or is greater than the reference width, in an example of PLUS, in the first line 1H. That is, the logic circuit 250 may adjust and/or set the width of the switching signals SS1 and SS2 based on a predetermined reference width.

In addition, similarly to the first line 1H, the logic circuit 250 may generate the switching signals SS3 and SS4 so that the width of the third switching signal SS3 and the width of the fourth switching signal SS4 become different from each other in the second line 2H. According to the examples, the logic circuit 250 may generate the switching signals SS3 and SS4 so that the width of the switching signals SS3 and SS4 is the reference width, in an example of ORIGIN, is smaller than the reference width, in an example of MINUS, or is greater than the reference width, in an example of PLUS, in the second line 2H.

According to the examples, the logic circuit 250 may adjust or set the width of the switching signals SS1 to SS4 so that a floating period, which is a period in which both the switching signals SS1 and SS3 or SS2 and SS4 are at a logic low level, is present or not present in each horizontal time interval. For example, as illustrated in the example of FIG. 4, the floating period of the switching signals SS1 and SS3 may be present in a first horizontal time interval 1H. However, the floating period of the switching signals SS1 and SS3 may not be present in a third horizontal time interval 3H.

As described above, although it has been described through examples that the logic circuit 250 adjusts the switching signals SS1 to SS4 in the two lines 1H and 2H, the logic circuit 250 may perform the same adjustment in a series of lines, and thus such an adjustment may occur in a similar example that uses three or more lines.

According to the examples, the adjustment operation for the switching signals SS1 and SS2 in the first line 1H may also be applied to the odd-numbered lines 3H, 5H, and so on, in the same manner, and the adjustment operation for the switching signals SS3 and SS4 in the second line 2H may also be applied to the even-numbered lines 2H, 4H, and so on, in the same manner.

In addition, the logic circuit 250 may generate the selection signals SELa and SELb so that the phase of the first selection signal SELa and the phase of the second selection signal SELb become different in the first line 1H. For example, the logic circuit 250 may generate the selection signals SELa and SELb so that each of the falling time point and the rising time point of the first selection signal SELa becomes different from each of the falling time point and the rising time point of the second selection signal SELb in the first line 1H. At this time, additionally, the width of the selection signals SELa and SELb may be kept the same.

As described above, although only one line 1H has been described through examples, the techniques used in examples may also be applied to a series of lines in the same manner. According to the examples, the adjustment operation for the selection signals SELa and SELb in the first line 1H may also be applied to the next consecutive lines 2H, 3H, and so on, in the same manner.

For convenience, the operation in which the logic circuit 250 according to the examples adjusts the width of the switching signals SS1 to SS4 or adjusts the phase of the selection signals SELa and SELb is referred to as a timing adjustment operation.

Figure 5:
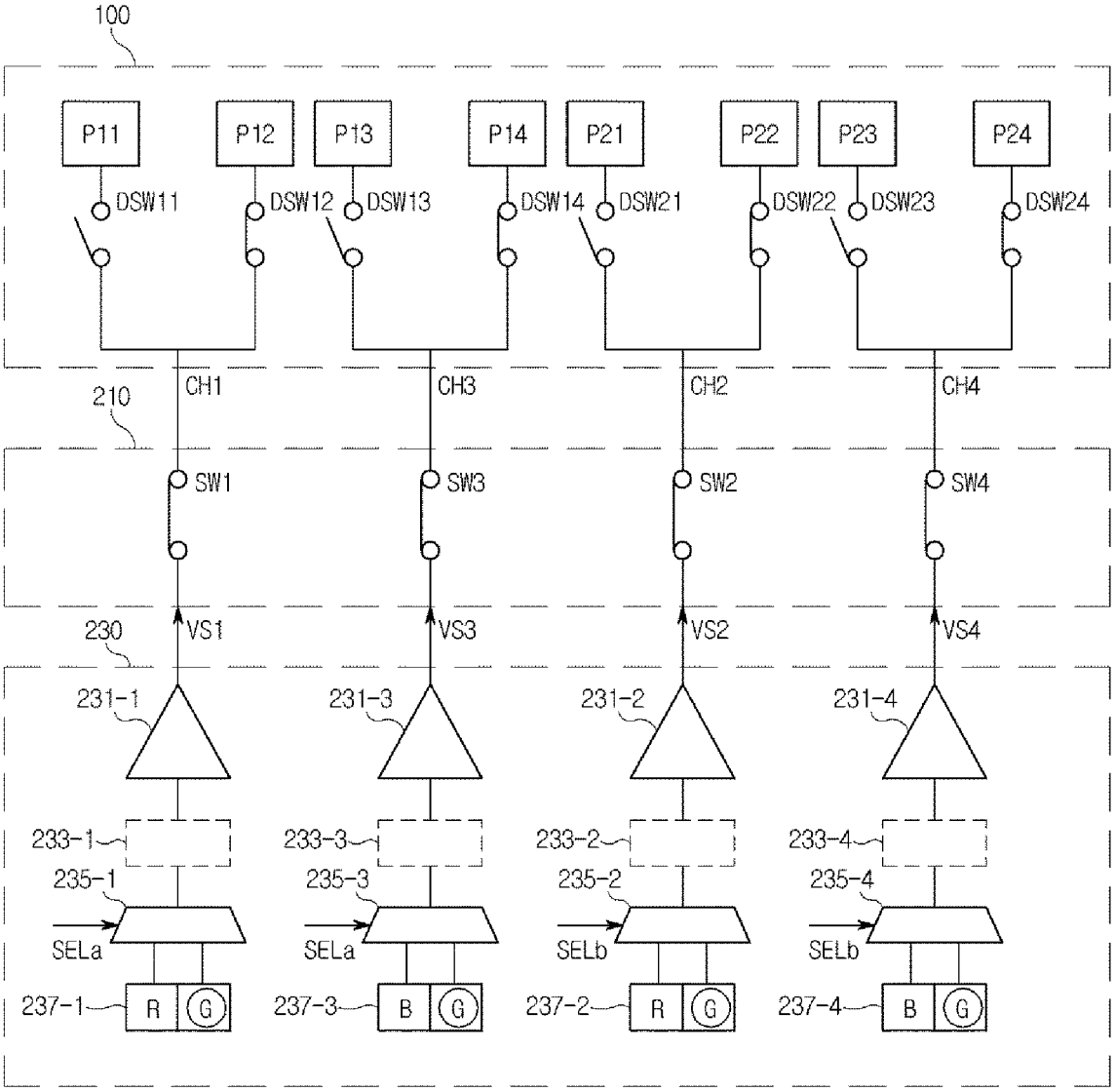
FIGS. 5 to 8 are diagrams illustrating the state of the display driving device at each time point.

An operation of the display driving device at a first time point $t_0$ in the example of FIG. 4 is described with further reference to the example of FIG. 5. Referring to the examples of FIGS. 4 and 5, at the first time point $t_0$, the first multiplexer 235-1 outputs one pixel data, for example, G, of the pixel data stored in the first latch 237-1 based on the first selection signal SELa of a logic low level, and the second multiplexer 235-2 outputs one pixel data, for example, G, of the pixel data stored in the second latch 237-2 based on the second selection signal SELb of a logic low level.

Similarly, the third multiplexer 235-3 outputs one pixel data, for example, G, of the pixel data stored in the third latch 237-3 based on the first selection signal SELa of a logic low level, and the fourth multiplexer 235-4 outputs one pixel data, for example, G, of the pixel data stored in the fourth latch 237-4 based on the second selection signal SELb of a logic low level.

At the first time point $t_0$, the first switch SW1 connects the first source amplifier 231-1 and the first channel CH1 based on the first switching signal SS1 of a logic high level. Also at the first time point $t_0$, the second switch SW2 connects the second source amplifier 231-2 and the second channel CH2 based on the second switching signal SS2 of a logic high level. Similarly, the third switch SW3 connects the third source amplifier 231-3 and the third channel CH3 based on the first switching signal SS1 of a logic high level, and also the fourth switch SW4 connects the fourth source amplifier 231-4 and the fourth channel CH4 based on the second switching signal SS2 of a logic high level.

Additionally, at the first time point $t_0$, the switches DSW12, DSW14, DSW22, and DSW24 connect each of the channels CH1, CH3, CH2, and CH4 and each of the pixels P11, P13, P21, and P23 to one another, based on the second data selection signal DSSb of a low level.

Figure 6:
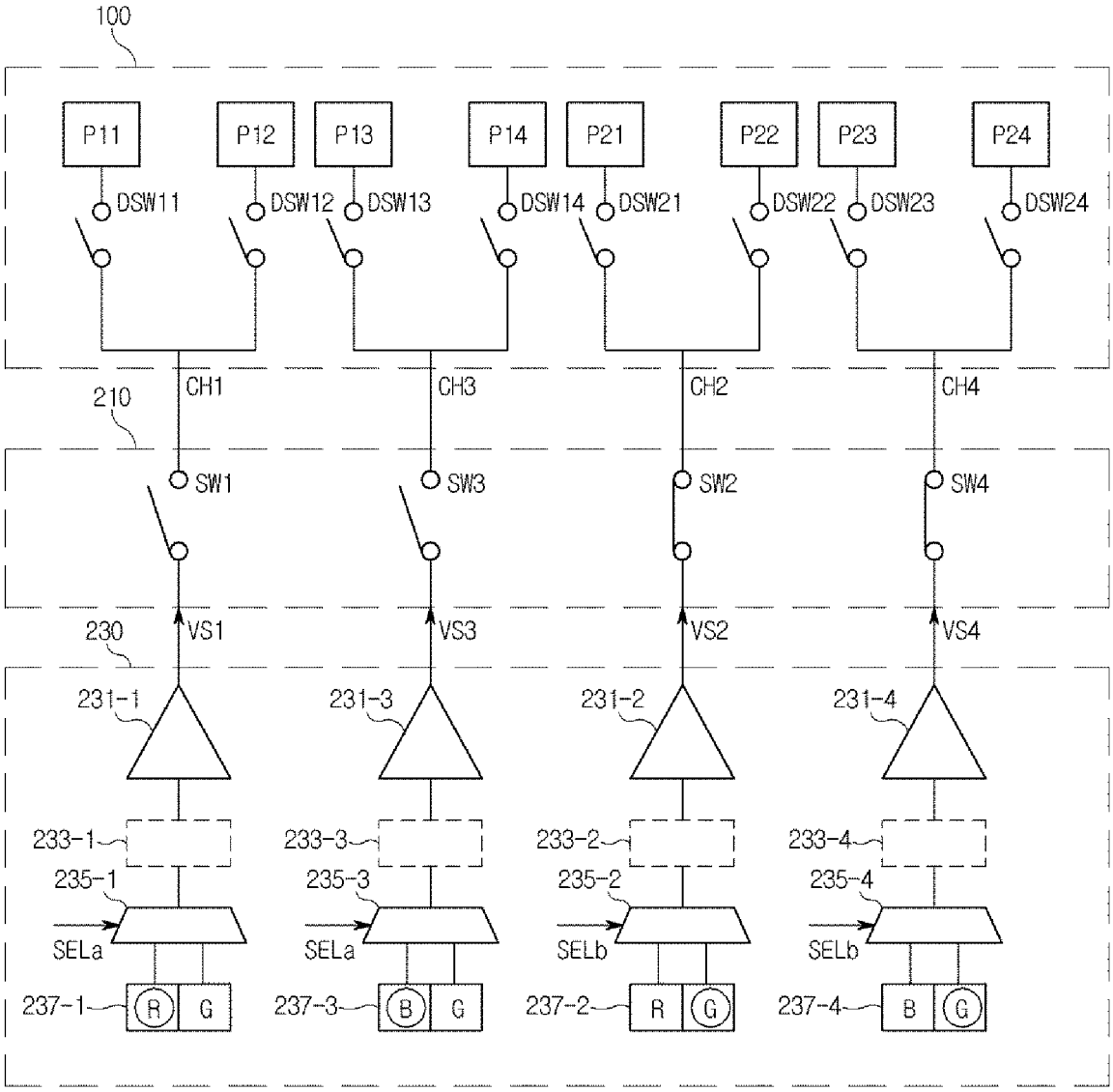

An operation of the display driving device at a second time point $t_1$ in the example of FIG. 4 is described with further reference to the example of FIG. 6. Referring to the examples of FIGS. 4 and 6, at the second time point $t_1$, the first multiplexer 235-1 outputs another pixel data, for example, R, stored in the first latch 237-1 based on the first selection signal SELa of a logic high level. As at the first time point $t_0$, the second multiplexer 235-2 outputs one pixel data, for example, G, stored in the second latch 237-2 based on the second selection signal SELb of a logic low level. That is, the level of only the first selection signal SELa of the selection signals SELa and SELb of a logic low level is changed. Accordingly, only the selection of the data of the first multiplexer 235-1 is changed, for example, from G to R. Similarly, the third multiplexer 235-3 outputs another pixel data, for example, B, stored in the third latch 237-3 based on the first selection signal SELa of a logic high level, and as at the first time point $t_0$, the fourth multiplexer 235-4 outputs one pixel data, for example, G, stored in the fourth latch 237-4 based on the second selection signal SELb of a logic low level.

Because the phase of the first selection signal SELa and the phase of the second selection signal SELb in the first line 1H differ from each other, the timing at which the data selection of the multiplexers 235-1 and 235-3 corresponding to the first set of the sub-pixels P11 to P14 changes. That is, the timing at which the level of the selection signal SELa varies, to differ from the timing at which the data selection of other multiplexers 235-2 and 235-4 corresponding to the second set of adjacent sub-pixels P21 to P24 changes. Accordingly, less EMI occurs in the display driving device than in the example in which the change timings of the data selections of the first and third multiplexers 235-1 and 235-3 and the second and fourth multiplexers 235-2 and 235-4 are the same. Thus, such an approach may reduce noise caused by the EMI.

In addition, at the second time point $t_1$, the first switch SW1 releases the connection between the first source amplifier 231-1 and the first channel CH1 based on the first switching signal SS1 of a logic low level. As at the first time point $t_0$, the second switch SW2 connects the second source amplifier 231-2 and the second channel CH2 based on the second switching signal SS2 of a logic high level. Similarly, the third switch SW3 connects the third source amplifier 231-3 and the third channel CH3 based on the first switching signal SS1 of a logic low level, and the fourth switch SW4 connects the fourth source amplifier 231-4 and the fourth channel CH4 based on the second switching signal SS2 of a logic high level.

Because the width of the first switching signal SS1 and the width of the second switching signal SS2 are different from each other during the first line 1H, the time point at which the first switching signal SS1 enters a logic low level and the time point at which the second switching signal SS2 enters a logic low level become different from each other. Accordingly, the switching timings of the switches SW1 and SW3 connected to the first set of sub-pixels P11 to P14, that is, the state change timings from turn-off to turn-on or from turn-on to turn-off, become different from the switching timings of the other switches SW2 and SW4 connected to the second set of adjacent sub-pixels P21 to P24. As a result, less EMI occurs in the display driving device than the example in which the switching timings of the switches SW1 to SW4 are the same, which may reduce noise caused by the EMI.

Figure 7:
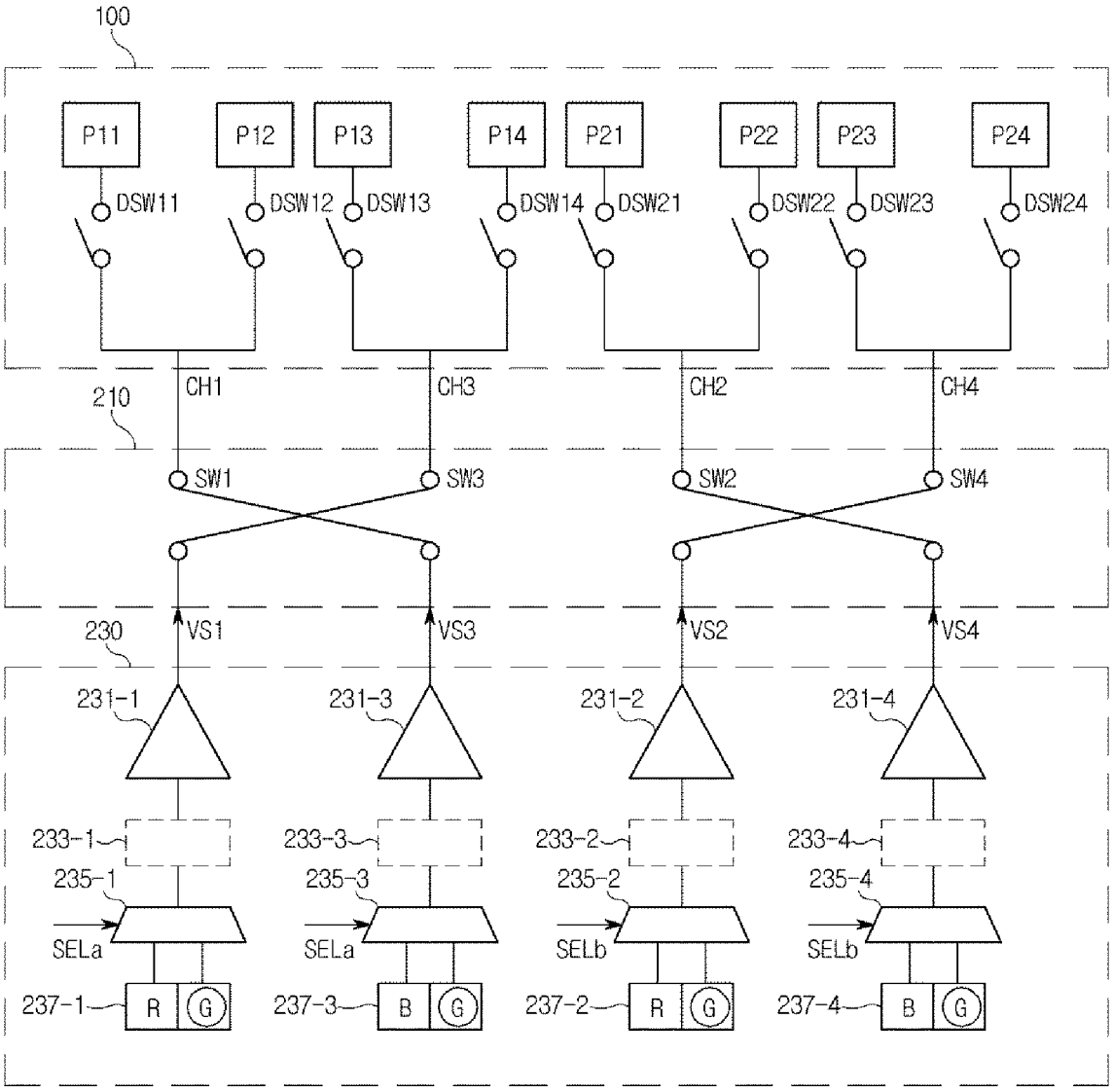

An operation of the display driving device at a third time point $t_2$ in the example of FIG. 4 is described further with reference to the example of FIG. 7. Meanwhile, because the operation of the multiplexers 235-1 to 235-4 at the third time point $t_2$ is the same as the operation of the multiplexers 235-1 to 235-4 at the first time point $t_0$, a description of such operation is omitted for brevity.

Referring to the examples of FIGS. 4 and 7, at the third time point $t_2$, the first switch SW1 connects the first source amplifier 231-1 and the third channel CH3 based on the third switching signal SS3 of a logic high level. Additionally, the second switch SW2 connects the second source amplifier 231-2 and the fourth channel CH4 based on the fourth switching signal SS4 of a logic high level. Similarly, the third switch SW3 connects the third source amplifier 231-3 and the first channel CH1 based on the third switching signal SS3 of a logic high level, and the fourth switch SW4 connects the fourth source amplifier 231-4 and the second channel CH2 based on the fourth switching signal SS4 of a logic high level.

Figure 8:
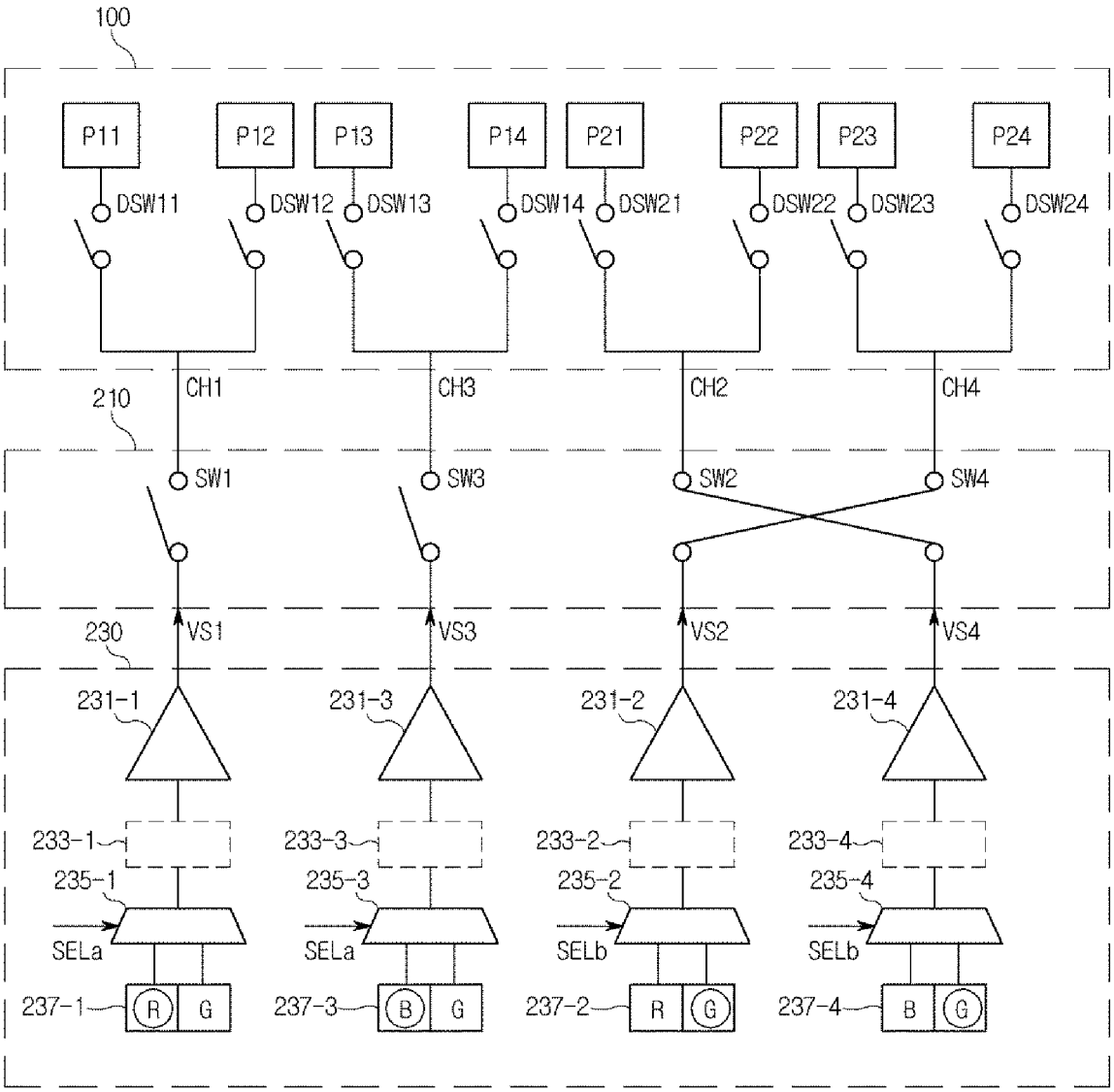

An operation of the display driving device at a fourth time point $t_3$ in the example of FIG. 4 is described further with reference to the example of FIG. 8. Meanwhile, because the operation of the multiplexers 235-1 to 235-4 at the fourth time point $t_3$ is the same as the operation of the multiplexers 235-1 to 235-4 at the second time point $t_1$, a description of such operation is omitted for brevity.

That is, because the phase of the first selection signal SELa and the phase of the second selection signal SELb in the second line 2H differ from each other, the timing at which the date selection of the multiplexers 235-1 and 235-3 corresponding to the first set of sub-pixels P11 to P14 is changed, that is, the timing at which the level of the selection signal SELa is changed, becomes different from the timing at which the data selection of the other multiplexers 235-2 and 235-4 corresponding to the second set of adjacent sub-pixels P21 to P24 is changed. As a result, less EMI occurs in the display driving device than in an example in which the change timings of the data selections of the first and third multiplexers 235-1 and 235-3 and the second and fourth multiplexers 235-2 and 235-4 are the same. Thus, using such an approach may reduce noise caused by the EMI.

Referring to the examples of FIGS. 4 and 8, at the fourth time point $t_3$, the first switch SW1 releases the connection between the first source amplifier 231-1 and the third channel CH3 based on the third switching signal SS3 of a logic low level. As at the first time point $t_0$, the second switch SW2 connects the second source amplifier 231-2 and the fourth channel CH4 based on the fourth switching signal SS4 of a logic high level. Similarly, the third switch SW3 releases the connection between the third source amplifier 231-3 and the first channel CH1 based on the third switching signal SS3 of a logic low level, and the fourth switch SW4 connects the fourth source amplifier 231-4 and the second channel CH2 based on the fourth switching signal SS4 of a logic high level.

Because the width of the third switching signal SS3 and the width of the fourth switching signal SS4 differ from each other during the second line 2H, the time point at which the third switching signal SS3 enters a logic low level and the time point at which the fourth switching signal SS4 enters a logic low level become different from each other. Accordingly, the switching timings of the switches SW1 and SW3 connected to the first set of sub-pixels P11 to P14 become different from the switching timings of the other switches SW2 and SW4 connected to the second set of adjacent sub-pixels P21 to P24. As a result, less EMI occurs in the display driving device than in the example in which the switching timings of the switches SW1 to SW4 are the same, thus reducing the noise caused by the EMI.

Figure 9:
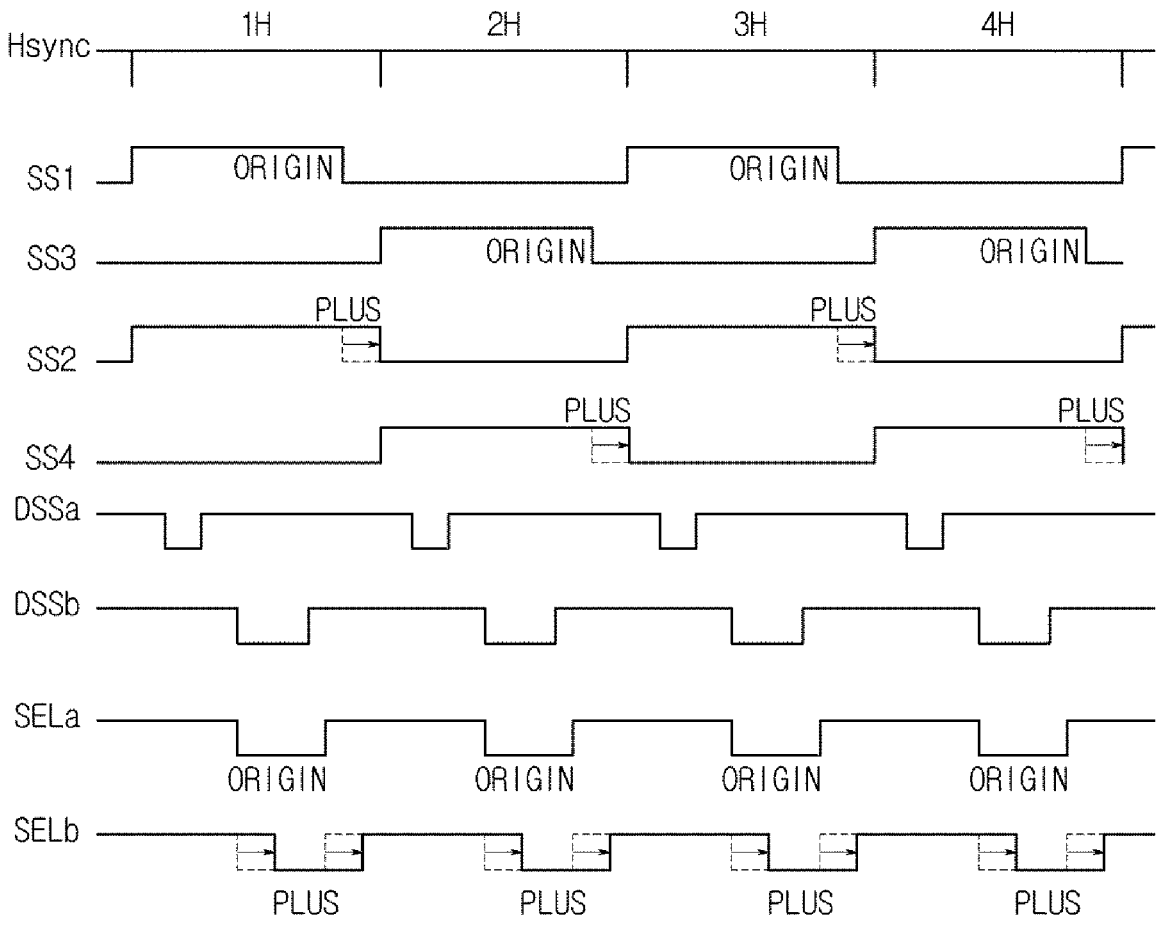
FIG. 9 is a timing diagram for explaining an operation of the display driving device according to an example.

FIG. 9 is a timing diagram for explaining an operation of the display driving device according to an example. As described above, in one horizontal time interval, the logic circuit 250 may adjust the width of the switching signals SS, and may adjust the phase of the selection signals SEL.

Unlike in the example of FIG. 4, the width of the first switching signal SS1 illustrated in the example of FIG. 9 is the same as the reference width, and the width of the second switching signal SS2 is greater than the reference width. That is, the display driving device 200 or the logic circuit 250, according to the examples, may adjust the width of the switching signals SS, and may adjust the phase of the selection signals SEL according to various methods.

Figure 10:
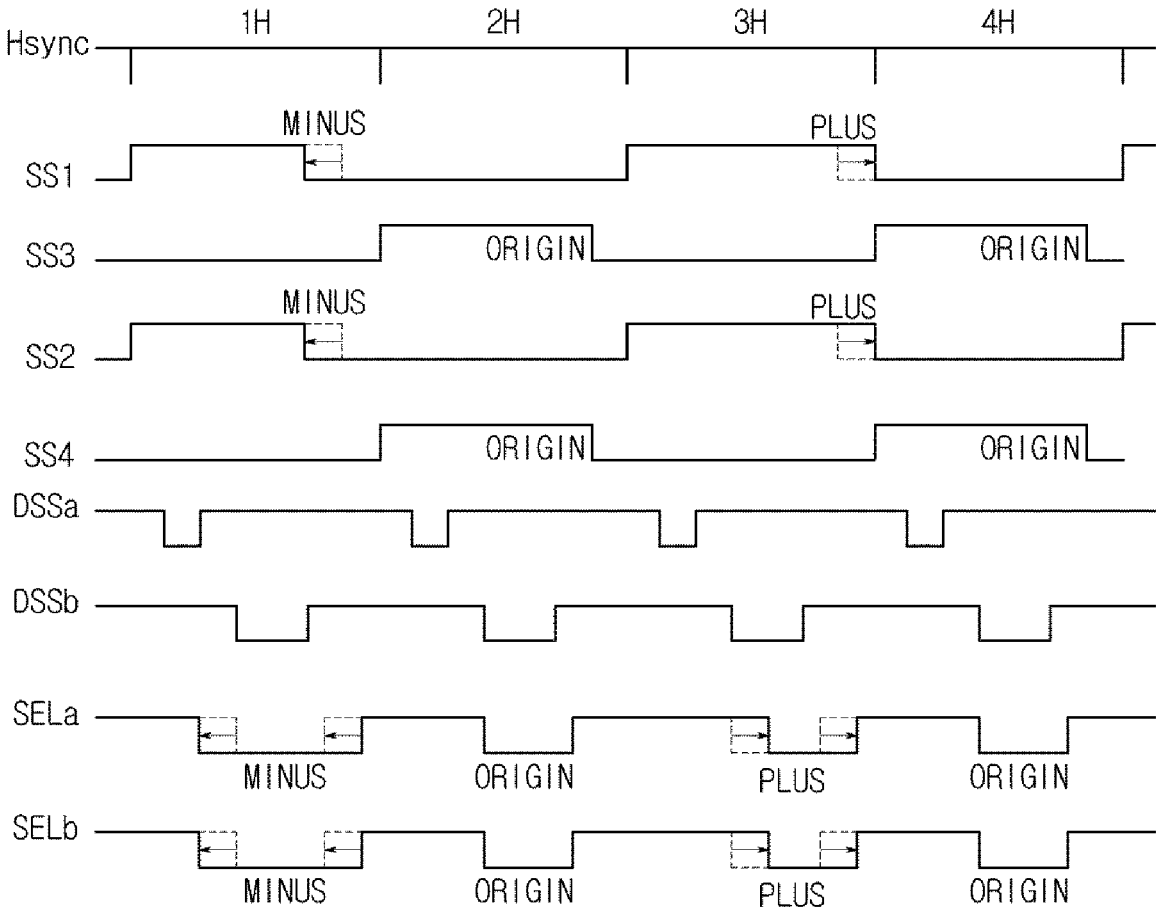
FIG. 10 is a timing diagram for explaining an operation of the display driving device according to an example.

FIG. 10 is a timing diagram for explaining an operation of the display driving device according to an example. Referring to the example of FIG. 10, the logic circuit 250 may adjust the width of each of the switching signals SS1 to SS4 in adjacent odd-numbered lines or adjacent even-numbered lines differently from each other. For example, as illustrated in the examples of FIGS. 3 and 5, the logic circuit 250 may adjust the width of the first switching signal SS1 in the adjacent odd-numbered lines differently from each other, and may adjust the width of the third switching signal SS3 in the adjacent even-numbered lines differently from each other.

Similarly, the logic circuit 250 may adjust the phase of each of the selection signals SELa and SELb in adjacent lines differently from each other. For example, as illustrated in the examples of FIGS. 3 and 5, the logic circuit 250 may adjust the phase of the first selection signal SELa in the adjacent lines differently from each other.

Therefore, the switching timings of the switches SW1 to SW4 in the adjacent lines, for example, lines 1H and 2H or lines 2H and 3H, and so on, or the data selection timings of the multiplexers 235-1 to 235-4 become different from each other. That is, the overall cycle of the switching or the data selection becomes uneven. As a result, less EMI occurs in the display driving device than in the example that the timings are the same. As a result, noise caused by the EMI may decrease.

Figure 11:
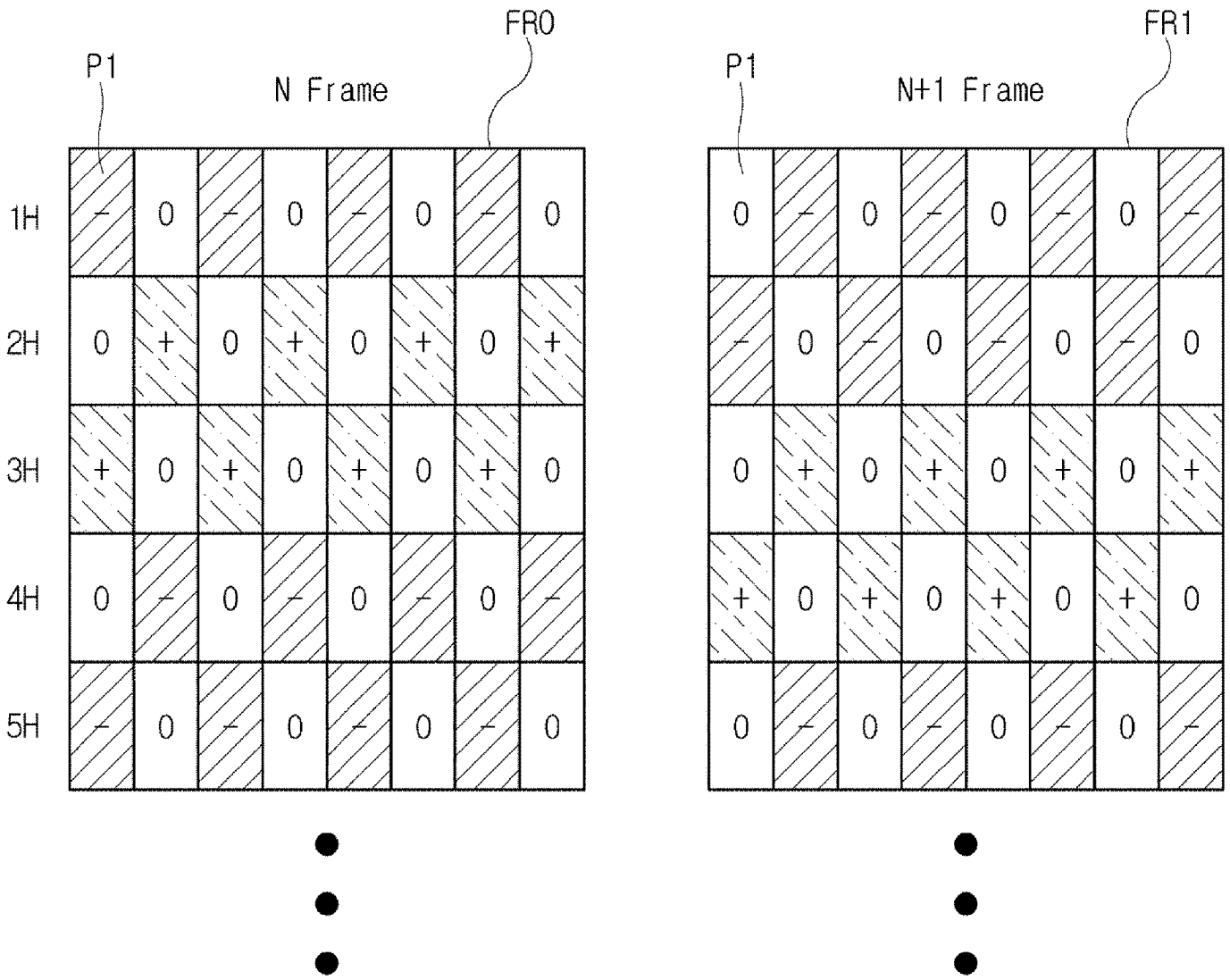
FIG. 11 is a diagram for explaining a timing adjustment operation of a logic circuit according to an example.
Figure 12:
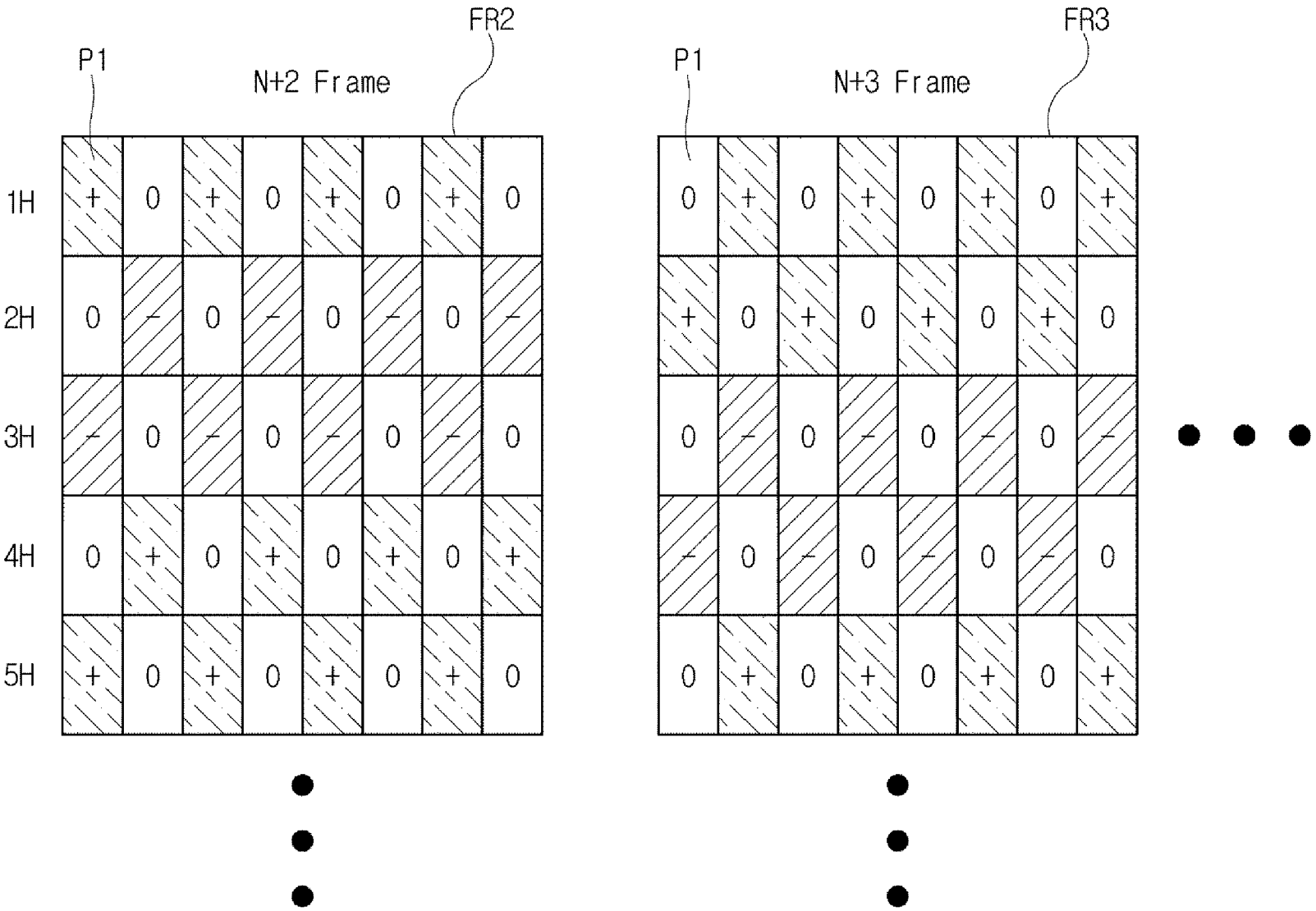
FIG. 12 is a diagram for explaining a timing adjustment operation of the logic circuit according to an example.

FIGS. 11 and 12 are diagrams for explaining a timing adjustment operation of the logic circuit according to examples. FIG. 11 illustrates a $N^{th}$ frame FR0, where N is a natural number, and a $(N+1)^{th}$ frame FR1, and FIG. 12 illustrates a $(N+2)^{th}$ frame FR2 and a $(N+3)^{th}$ frame FR3.

Each block of the respective frames FR0 to FR3 may correspond to a timing connected with one set of sub-pixels in one horizontal time interval. For example, a block P1 may correspond to the data selection timings of the first multiplexer 235-1 and the third multiplexer 235-3 or the switching timings of the first switch SW1 and the third switch SW3 corresponding to the first set of sub-pixels P11 to P14 in the first horizontal time 1H within the respective frames FR0 to FR3. Similarly, a block disposed at the right of the block P1 may correspond to the data selection timings of the second multiplexer 235-2 and the fourth multiplexer 235-4 or the switching timings of the second switch SW2 and the fourth switch SW4 corresponding to the second set of sub-pixels P21 to P24 in the first horizontal time 1H within the respective frames FR0 to FR3.

Likewise, each column of the respective frames FR0 to FR3 may correspond to a timing connected with one set of sub-pixels in a plurality of horizontal time intervals.

In the examples of FIG. 11 and FIG. 12, the symbol "+" illustrated in each block of the frames FR0 to FR3 indicates that the corresponding timing is slower than the reference timing. That is, the symbol "+" indicates that the width or phase of the switching signal SS or selection signal SEL, respectively, corresponding to the block is a greater width or a later phase than the reference width or the reference phase, appropriately.

In the examples of FIG. 11 and FIG. 12, the symbol "−" illustrated in each block of the frames FR0 to FR3 indicates that the corresponding timing is faster than the reference timing. That is, the symbol "−" indicates that the width or phase of the switching signal SS or selection signal SEL, respectively, corresponding to the block is a smaller width or a faster phase than the reference width or reference phase, appropriately.

In the examples of FIG. 11 and FIG. 12, the symbol "0" illustrated in each block of the frames FR0 to FR3 indicates that the corresponding timing is the same as the reference timing. That is, "0" indicates that the width or phase of the switching signal SS or selection signal SEL, respectively corresponding to the block is the same as the reference width or reference phase, appropriately.

According to the examples, the logic circuit 250 may adjust the width of the switching signals SS1 to SS4 or the phase of the selection signals SELa and SELb so that a difference in timing between the blocks in a certain number of lines becomes the same. For example, the logic circuit 250 may perform adjustments so that the sum of the width difference between the switching signals SS1 and SS2 or SS3 and SS4, or the sum of the phase difference between the selection signals SELa and SELb, in the lines, for example, four lines, as shown in examples, becomes 0. As illustrated in the examples of FIGS. 11 and 12, the number of occurrences of the symbol "−" and the number of occurrences of the symbol "+" in a range of 1H to 4H may be the same.

Similarly, the logic circuit 250 may adjust the width of the switching signals SS1 to SS4 or the phase of the selection signals SELa and SELb so that a difference in timing between the blocks within a certain number of frames becomes the same. For example, the logic circuit 250 may perform adjustments so that the sum of the width difference between the switching signals SS1 and SS2 or SS3 and SS4, or, likewise, the sum of the phase difference between the selection signals SELa and SELb, within the frames FR0 to FR3 becomes 0. As illustrated in the examples of FIGS. 11 and 12, the number of occurrences of the symbol "−" and the number of occurrences of the symbol "+" in a range of the FR0 to FR3 may be the same.

That is, when parts of the logic circuit 250 belong to frames different from each other even in the same line, the corresponding switching timing or data selection timing may become different, thus adjusting the timing so that the deviation of the whole frame becomes 0.

According to the examples, the logic circuit 250 may adjust the width of the switching signals SS and may adjust the phase of the selection signals SEL, based on a first counter that operates based on the horizontal synchronization signal Hsync and is composed of a four-cycle counter or a two-bit counter, and a second counter that operates based on the vertical synchronization signal Vsync and is also composed of a four-cycle counter or a two-bit counter. The counters may be implemented by a hardware counter or a software counter.

In the present disclosure, the four-cycle counter refers to a counter that periodically generates four count values, for example, "00", "01", "10", and "11". That is, when the first counter generates a first count value in a first line 1H, the first count value may also be generated again in a fifth line. Similarly, when the second counter generates the first count value in a first vertical time, the first count value may be generated again in a fifth vertical time.

According to the examples, the logic circuit 250 may sequentially adjust the width of the switching signals SS1 to SS4 and may also sequentially adjust the phase of the selection signals SELa and SELb according to the count values generated by the first counter in order to perform a timing adjustment operation for each line.

For example, the logic circuit 250 may set the width of the first switching signal SS1 to be smaller than the reference width when the first counter generates a first count value, for example, "00", in a first line 1H, set the width of the first switching signal SS1 as the reference width when the first counter generates a second count value, for example, "01", in a second line 2H, set the width of the first switching signal SS1 to be greater than the reference width when the first counter generates a third count value, for example, "10", in a third line 3H, and set the width of the first switching signal SS1 as the reference width when the first counter generates a fourth count value, for example, "11", in a fourth line 4H.

Meanwhile, when the width of the other switching signals SS2 to SS4 is adjusted, the logic circuit 250 may use the shifting the count values generated by the first counter. For example, when the first counter generates the first count value in the first line 1H, the logic circuit 250 may adjust the width of the second switching signal SS2 based on a value obtained by shifting the first count value, that is, the second count value.

For example, the logic circuit 250 may set the phase of the first selection signal SELa to be earlier than the reference phase when the first counter generates the first count value, for example, "00", may set the phase of the first selection signal SELa as the reference phase when the first counter generates the second count value, for example, "01", may set the phase of the first selection signal SELa to be later than the reference phase when the first counter generates the third count value, for example, "10", and may set the phase of the first selection signal SELa as the reference phase when the first counter generates the fourth count value, for example, "11".

The logic circuit 250 may adjust the width of the switching signals SS and may adjust the phase of the selection signals SEL according to the sum of the count value generated by the first counter and the value generated by the second counter in order to perform a timing adjustment operation for each frame. When a frame is different even in the same line, the width of the switching signals SS1 to SS4 or the phase of the selection signals SELa and SELb may be adjusted accordingly so that a difference in the timing between the blocks within the frames becomes the same by shifting the count value corresponding to the line.

For example, as illustrated in the examples of FIGS. 11 and 12, the timing of the block P1 in the $N^{th}$ frame FR0 and the timing of the block P1 in the $(N+1)^{th}$ frame FR1 may differ from each other.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A display driving device for driving a display panel, the display driving device comprising:

a first driving circuit configured to output a first image signal;

a second driving circuit configured to output a second image signal;

a first switch circuit connected to the first driving circuit, and configured to transmit the first image signal to a part of a first set of sub-pixels arranged in the display panel based on a first switching signal during a first horizontal time interval; and a second switch circuit connected to the second driving circuit, and configured to transmit the second image signal to a part of a second set of sub-pixels arranged in the display panel adjacent to the first set of sub-pixels based on a second switching signal during the first horizontal time interval, wherein a width of the first switching signal and a width of the second switching signal in the first horizontal time differ from each other, and the width of the first switching signal is a first width of three different widths and the width of the second switching signal is a second width of the three different widths.

2. The display driving device of claim 1, wherein a falling time point of the first switching signal is earlier than a falling time point of the second switching signal during the first horizontal time interval.

3. The display driving device of claim 2, wherein a rising time point of the first switching signal is the same as a rising time point of the second switching signal during the first horizontal time interval.

4. The display driving device of claim 1, wherein the first switch circuit is further configured to transmit the first image signal to another part of the first set of sub-pixels based on a third switching signal during a second horizontal time interval following the first horizontal time interval, wherein the second switch circuit is further configured to transmit the second image signal to another part of the second set of sub-pixels based on a fourth switching signal during the second horizontal time interval, and wherein a width of the third switching signal and a width of the fourth switching signal differ from each other during the second horizontal time interval.

5. The display driving device of claim 1, wherein the first driving circuit comprises:

a first multiplexer configured to output one pixel data of first pixel data and second pixel data in response to a first selection signal received during the first horizontal time interval, wherein the second driving circuit comprises:

a second multiplexer configured to output one pixel data of third pixel data and fourth pixel data in response to a second selection signal received during the first horizontal time interval, wherein a phase of the first selection signal and a phase of the second selection signal differ from each other during the first horizontal time interval, and wherein a width of the first selection signal and a width of the second selection signal are the same.

6. The display driving device of claim 5, wherein a falling time point of the first selection signal is earlier than a falling time point of the second selection signal during the first horizontal time interval.

7. The display driving device of claim 5, wherein the first driving circuit further comprises:

a first latch configured to output the first pixel data and the second pixel data into the first multiplexer, and a first source amplifier configured to output a first voltage corresponding to the one pixel data output from the first multiplexer into the first set of sub-pixels as the first image signal, and wherein the second driving circuit further comprises:

a second latch configured to output the third pixel data and the fourth pixel data into the second multiplexer, and a second source amplifier configured to output a second voltage corresponding to the one pixel data output from the second multiplexer into the second set of sub-pixels as the second image signal.

8. The display driving device of claim 1, wherein the display driving device further comprises a logic circuit configured to adjust the width of the first switching signal and the width of the second switching signal.

9. The display driving device of claim 8, wherein the logic circuit is further configured to sequentially set the width of the first switching signal in each horizontal period as being a reference width, as being a value smaller than the reference width, as being the reference width, and as being a value greater than the reference width based on a four-cycle counter.

10. The display driving device of claim 1, wherein the second width is smaller than the first width and a third width of the three different widths is larger than the first width.

11. A display device comprising a display panel and a display driving device for driving the display panel, wherein the display panel comprises sub-pixels arranged in the display panel; and wherein the display driving device comprises:

a first driving circuit configured to output a first image signal;

a second driving circuit configured to output a second image signal;

a first switch circuit connected to the first driving circuit, and configured to transmit the first image signal to a part of a first set of sub-pixels arranged in the display panel based on a first switching signal during a first horizontal time interval; and a second switch circuit connected to the second driving circuit, and configured to transmit the second image signal to a part of a second set of sub-pixels arranged in the display panel adjacent to the first set of sub-pixels based on a second switching signal during the first horizontal time interval, and wherein a width of the first switching signal and a width of the second switching signal in the first horizontal time interval differ from each other, and the width of the first switching signal is a first width of three different widths and the width of the second switching signal is a second width of the three different widths.

12. The display device of claim 11, wherein a falling time point of the first switching signal is earlier than a falling time point of the second switching signal in the first horizontal time interval.

13. The display device of claim 11, wherein the first driving circuit comprises:

a first multiplexer configured to output one pixel data of first pixel data and second pixel data in response to a first selection signal received during the first horizontal time interval, wherein the second driving circuit comprises:

a second multiplexer configured to output one pixel data of third pixel data and fourth pixel data in response to a second selection signal received during the first horizontal time interval, wherein a phase of the first selection signal and a phase of the second selection signal differ from each other during the first horizontal time interval, and wherein a width of the first selection signal and a width of the second selection signal are the same.

14. The display device of claim 11, wherein the display driving device further comprises:

a logic circuit configured to adjust the width of the first switching signal and the width of the second switching signal, wherein the logic circuit is further configured to sequentially set the width of the first switching signal during each horizontal period as being a reference width, as being a value smaller than the reference width, as being the reference width, and as being a value greater than the reference width based on a four-cycle counter.

15. A display driving device for driving a display panel in which a plurality of pixels are arranged in parallel, the display driving device comprising:

a first driving circuit unit configured to output a first image signal into an odd-numbered pixel among the plurality of pixels;

a second driving circuit unit configured to output a second image signal into an even-numbered pixel among the plurality of pixels;

a first switch circuit unit interposed between the odd-numbered pixel and the first driving circuit unit, and configured to perform a switching operation for connecting the odd-numbered pixel and the first driving circuit unit; and a second switch circuit unit interposed between the even-numbered pixel and the second driving circuit unit, and configured to perform a switching operation for connecting the even-numbered pixel and the second driving circuit unit, wherein a switching timing of the first switch circuit unit and a switching timing of the second switch circuit unit differ from each other, and the switching timing of the first switch circuit unit is a first switching timing of three different switching timings and the switching timing of the second switch circuit unit is a second switching timing of the three different switching timings.

16. The display driving device of claim 15, further comprising a plurality of first switch circuits, wherein the switching timing of each of the plurality of first switch circuit units is the same, and further comprising a plurality of second switch circuits, wherein the switching timing of each of the plurality of second switch circuit units is the same.

17. The display driving device of claim 15, wherein the first switch circuit unit is further configured to perform the switching operation for connecting the odd-numbered pixel and the first driving circuit unit in response to a first switching signal, wherein the second switch circuit unit is further configured to perform the switching operation for connecting the even-numbered pixel and the second driving circuit unit in response to a second switching signal, and wherein a width of the first switching signal and a width of the second switching signal differ from each other.

18. The display driving device of claim 15, wherein the first driving circuit unit is further configured to perform a data selection operation for selecting a part of the input pixel data, wherein the second driving circuit unit is further configured to perform a data selection operation for selecting a part of the input pixel data, and wherein a data selection timing of the first driving circuit unit and a data selection timing of the second driving circuit unit are different from each other.

19. A display device comprising a display panel and a display driving device for driving the display panel, wherein the display panel comprises a plurality of pixels arranged in the display panel, wherein the display driving device comprises:

a first driving circuit unit configured to output a first image signal into an odd-numbered pixel among the plurality of pixels;

a second driving circuit unit configured to output a second image signal into an even-numbered pixel among the plurality of pixels;

a first switch circuit unit interposed between the odd-numbered pixel and the first driving circuit unit, and configured to perform a switching operation for connecting the odd-numbered pixel and the first driving circuit unit; and a second switch circuit unit interposed between the even-numbered pixel and the second driving circuit unit, and configured to perform a switching operation for connecting the even-numbered pixel and the second driving circuit unit, wherein a switching timing of the first switch circuit unit and a switching timing of the second switch circuit unit differ from each other, and the switching timing of the first switch circuit unit is a first switching timing of three different switching timings and the switching timing of the second switch circuit unit is a second switching timing of the three different switching timings.

20. The display device of claim 19, further comprising a plurality of first switch circuits, wherein the switching timing of each of the plurality of first switch circuit units is the same, and further comprising a plurality of second switch circuits, wherein the switching timing of each of the plurality of second switch circuit units is the same.

21. The display device of claim 18, wherein the first switch circuit unit is further configured to perform the switching operation for connecting the odd-numbered pixel and the first driving circuit unit in response to a first switching signal, wherein the second switch circuit unit is further configured to perform the switching operation for connecting the even-numbered pixel and the second driving circuit unit in response to a second switching signal, and wherein a width of the first switching signal and a width of the second switching signal differ from each other.

22. The display device of claim 18, wherein the first driving circuit unit is further configured to perform a data selection operation for selecting a part of the input pixel data, wherein the second driving circuit unit is further configured to perform a data selection operation for selecting a part of the input pixel data, and wherein a data selection timing of the first driving circuit unit and a data selection timing of the second driving circuit unit are different from each other.

* * * * *